US005934840A

United States Patent [19]

Nicholson

[11] Patent Number: 5,934,840

[45] Date of Patent: Aug. 10, 1999

[54] EXCAVATION SUPPORT STRUCTURE

[75] Inventor: Peter J. Nicholson, Canonsburg, Pa.

[73] Assignee: Geocon, Monroeville, Pa.

[21] Appl. No.: 08/949,323

[22] Filed: Oct. 3, 1997

[51] Int. Cl.[6] ..... E02D 5/02; E02D 5/18; E02D 9/00

[52] U.S. Cl. ..... 405/272; 405/229; 405/258

[58] Field of Search ..... 405/272, 273, 405/262, 249, 149, 133, 229, 230, 284, 285, 286, 258

[56] References Cited

U.S. PATENT DOCUMENTS

| | | | |
|---|---|---|---|
| 435,142 | 8/1890 | Harris | 405/229 |
| 543,230 | 7/1895 | Dubbs | 405/133 |
| 1,014,656 | 1/1912 | Legrand | 405/133 |
| 1,202,545 | 10/1916 | McCarthy | 405/272 |
| 1,909,980 | 5/1933 | Newman | 405/267 |
| 2,149,957 | 3/1939 | Dawson | 405/273 |
| 3,326,003 | 6/1967 | Marconi | 405/267 |
| 3,468,131 | 9/1969 | Seidenberg | 405/258 |

(List continued on next page.)

FOREIGN PATENT DOCUMENTS

| | | | |
|---|---|---|---|
| 609238 | 2/1935 | Germany | 405/229 |
| 716110 | 1/1942 | Germany | 405/229 |

OTHER PUBLICATIONS

T. Watanabe, et al., "Development and application of new Deep Mixing Soil Improvement Method to form a rectangular stabilized soil Mass", pp. 783–786; Grouting and Deep Mixing, 1996.

K. Unami et al., "Deep Mixing Method at Ukishima Site of the Trans–Tokyo Bay Highway Project", pp. 777–782, Grouting and Deep Mixing, 1996.

K. Uchida et al., "Ground improvement by cement–treatment in Trans–Tokyo Bay Highway Project", pp. 669–674, Grouting and Deep Mixing, 1996.

Nobuhiro Tsuchiya, et al., "Effects of measures against lateral soil flow using multi–cell blocks imrpoved by the Square Deep Mixing Method", pp. 569–572, Grouting and Deep Mixing, 1996.

Teruhiko Mizutani, et al., "Assessment of the quality of soil–cement columns of square and rectangular shapes formed by a Deep Mixing Method", pp. 637–642, Grouting and Deep Mixing, 1996.

T. Hirai et al., "Development and application of Deep Mixing Soil Stabilization Method to control displacement of adjacent ground", pp. 485–490, Grouting and Deep Mixing, 1996.

Jun Dong, et al., "Experimental study of behavior of composite ground improved by Deep Mixing Method under lateral earth pressure", pp. 585–590, Grouting and Deep Mixing, 1996.

R. Babasaki, et al., "Open cut excavation of soft ground using the DCM Method", pp. 469–473, Grouting and Deep Mixing, 1996.

H. J. Liao, et al., "Grouting for retaining wall movement control of a deep excavation in soft clay", pp. 403–416, Grouting in the Ground, Institution of Civil Engineers, Thomas Telford, London, 1992.

C. N. Haman, et al., "Colmix: the process and its applications", pp. 511–524, Grouting in the Ground, Institution of Civil Engineers, Thomas Telford, London, 1992.

*Primary Examiner*—Dennis L. Taylor
*Attorney, Agent, or Firm*—Fish & Richardson P.C.

[57] ABSTRACT

An excavation support structure has a vertical face and includes an array of two or more soil-cement columns positioned internal to the vertical face. The columns are positioned within the array so that each of the columns is not connected by soil-cement to any other column. Soil surrounds the soil-cement columns except where the soil-cement columns meet the vertical surface. The soil-cement columns are distributed within the support structure so as to form a composite structure with the soil.

24 Claims, 15 Drawing Sheets

U.S. PATENT DOCUMENTS

| | | | |
|---|---|---|---|
| 3,800,544 | 4/1974 | Nakanishi . | |
| 4,212,565 | 7/1980 | Watabe . | |
| 4,242,013 | 12/1980 | Watts | 405/272 |
| 4,508,472 | 4/1985 | Handy et al. | 405/229 |
| 4,653,962 | 3/1987 | McKittrick et al. | 405/262 X |
| 4,728,225 | 3/1988 | Brandl et al. | 405/262 |
| 4,886,400 | 12/1989 | Taki et al. . | |
| 4,906,142 | 3/1990 | Taki et al. . | |
| 5,013,185 | 5/1991 | Taki . | |
| 5,118,223 | 6/1992 | Taki . | |
| 5,135,058 | 8/1992 | Millgard et al. . | |
| 5,190,412 | 3/1993 | Salvatore | 405/272 |
| 5,294,215 | 3/1994 | Millgard . | |

a) PARALLEL DSM WALL CONFIGURATION (CONSERVATIVE)

b) STAGGERED DSM PANEL CONFIGURATION (CONSERVATIVE)

EXCAVATION SUPPORT STRUCTURE

BACKGROUND

The invention relates to an excavation support structure that is constructed using deep cement soil mixing (DSM) and shallow cement soil mixing (SSM) to provide, in effect, a self-supporting, composite gravity wall structure.

In general, as shown in FIG. 20, DSM and SSM are soil treatment techniques in which soil 900 is blended with cement and other materials introduced in dry or mixed form through a hollow, rotating mixing shaft 910 equipped with cutting heads 920. The shaft 910 is mounted vertically on a suitable carrier 930. The resulting cemented soil 940 material generally has a higher strength and lower compressibility than the native soil 900. DSM and SSM have been used in a number of applications, such as hydraulic cut-off walls, excavation support walls, ground treatment, liquefaction mitigation, in situ reinforcement, and environmental remediation. For example, in an excavation support application, an overlapping row or array of soil-cement columns 940 may be formed along the excavation line. The resulting wall of soil-cement columns provides structural support and ground water control for excavation projects.

SUMMARY

The invention features an excavation support structure with a vertical face. In one aspect, the support structure includes two or more rows of non-overlapping soil-cement columns positioned internal to the vertical face, and each row has at least two soil-cement columns. Soil surrounds the soil-cement columns.

Embodiments may include one or more of the following features. The soil-cement columns may be distributed within the support structure so as to form a composite structure with the soil surrounding the soil-cement columns. The soil-cement columns may be distributed within the support structure so that failure due to formation of a shear surface occurs at a lesser applied force than failure due to extrusion of soil between the columns.

The inside face of the support structure may be exposed. The soil-cement columns may be cylindrical. A wall may be constructed along the inside face. The volume of the columns may be less than about 35% of the total volume of the support structure.

In another aspect, the support structure may include a wall along the inside face. Rows of soil-cement columns are perpendicular to and adjoin the wall, and each row has at least two soil-cement columns. The rows of soil-cement columns are surrounded by soil except where the rows adjoin the wall.

Embodiments may include one or more of the features noted above. In addition, groups of soil-cement columns that are surrounded by soil may be positioned between the rows of soil-cement columns.

In another aspect, the support structure may include a primary row of soil-cement columns along the inside face. Secondary rows of soil-cement columns are perpendicular to and adjoin the primary row, and each secondary row has at least two soil-cement columns. The secondary rows of soil-cement columns are surrounded by soil except where the secondary rows adjoin the primary row.

Embodiments may include one or more of the features noted above. In addition, the volume of the secondary rows of soil-cement columns may be less than about 35% of the total volume of the secondary rows of soil-cement columns and the soil surrounding the secondary rows. Groups of soil-cement columns that are surrounded by soil may be positioned between the secondary rows of soil-cement columns.

Finally, the support structure may include an array of two or more soil-cement columns positioned internal to the vertical face. The columns may be positioned within the array so that each of the columns is not connected by soil-cement to any other column.

Other features and advantages will be apparent from the following detailed description, including the drawings, and from the claims.

DESCRIPTION

Figure 1:
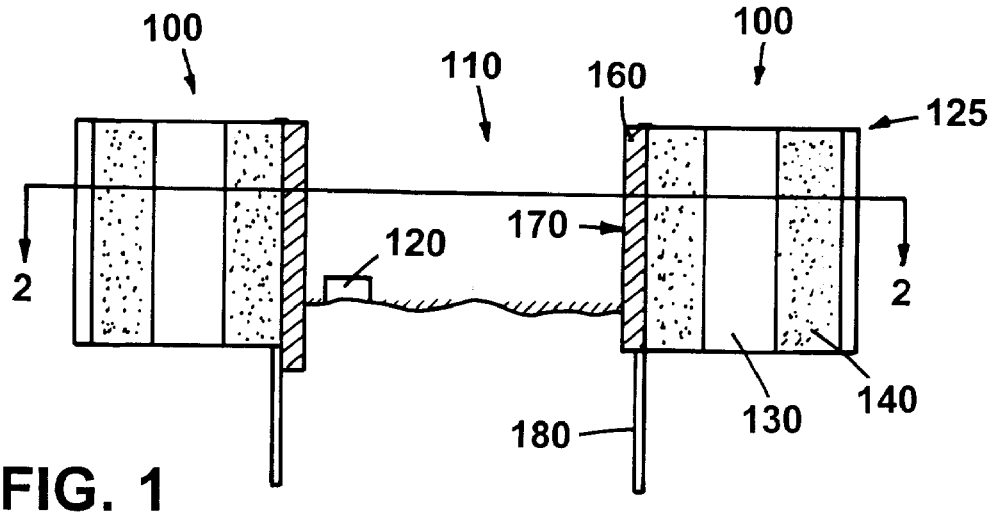
FIG. 1 is a sectional view of an excavation support structure.
Figure 2:
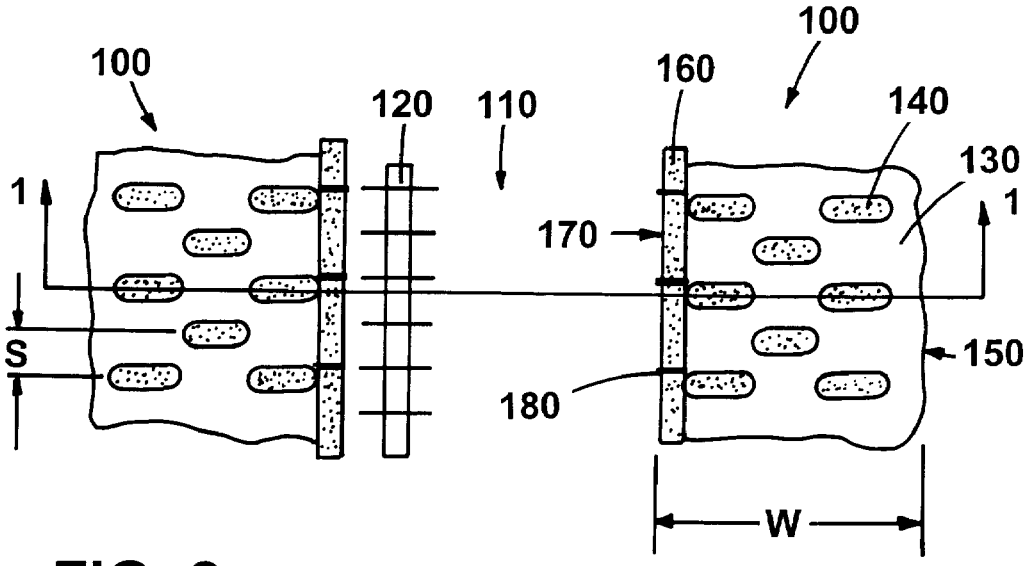
FIG. 2 is an overhead sectional view of the excavation support structure of FIG. 1, along section 2—2 of FIG. 1.

Referring to FIGS. 1 and 2, excavation support structures 100 constructed along the sides of an area 110 to be excavated provide permanent retention of soil behind the support structures 100. For example, an excavation may be performed to construct a road or railway 120 that is below ground level 125.

The excavation support structure 100 is formed by stabilizing a volume of soil 130 using interspersed soil-cement columns 140. The soil-cement columns 140 are formed in situ prior to excavation, using well-known techniques such as are described above. The soil-cement columns 140 and the untreated soil 130 surrounding the soil-cement columns interact to form a composite gravity wall structure. The mass of this composite structure is sufficient to sustain the lateral forces exerted by untreated soil on the sides of the gravity wall facing away from the excavated area (outside boundaries 150).

The inside face 170 of the excavation support structure 100 may include an array of metal soldier beams 180. The soldier beams 180 typically extend deeper into the ground than the soil-cement columns 140. In addition, an architectural concrete wall 160 may be placed on the inside faces 170 of the structure. This design has been developed for excavations of up to 40 feet deep but can be modified for deeper excavations. When water is present above the base of the excavation, an interlocking soil/cement face may be established.

The composite structure provides permanent support and reduces the structural strength required for the permanent wall 160 constructed on the surface of the structure facing the excavated area (inside faces 170). The composite action of the cemented soil 140 and untreated soil 130 in the gravity wall structure means that water and soil pressures against the wall 160 on the inside face 170 are reduced or eliminated.

In the example shown in FIGS. 1 and 2, the excavated area 110 for the section of railway 120 is positioned approximately nine meters below ground level. The soil-cement columns 140 measure approximately 0.9 meters by 2.7 meters and are just over nine meters in height. The spacing, s, between rows of columns 140 is about 2 meters along the length of the inside face of the wall. The volume ratio of cemented soil replacement of untreated native soil is approximately 20%, i.e. the soil-cement columns 140 constitute 20% of the total volume of the support structure 100. Due to the composite action of the soil-cement columns and untreated soil, the effective width, w, of the support structure is approximately eight meters from the inside face 170 of the wall 160 to the outside boundary 150. A gravity wall of this width provides sufficient structural support for the nine meter deep excavation employed. Testing and analysis have shown replacement ratios of between 15% and 35% (ratio of cemented soil to total volume) provide sufficient cementing action to provide composite action of the entire gravity wall mass, although higher replacement ratios can be used.

The overall volume of the support structure is 72 cubic meters per meter of wall facing. At a replacement ratio of 20%, the approximate volume of soil-cement mix is 15 cubic meters per meter of wall facing. Therefore, the cost of the support structure is approximately one fifth that of a solid soil-cement support structure. In addition, the cost is approximately one half that of conventional anchored wall construction per unit of length.

Figure 4:
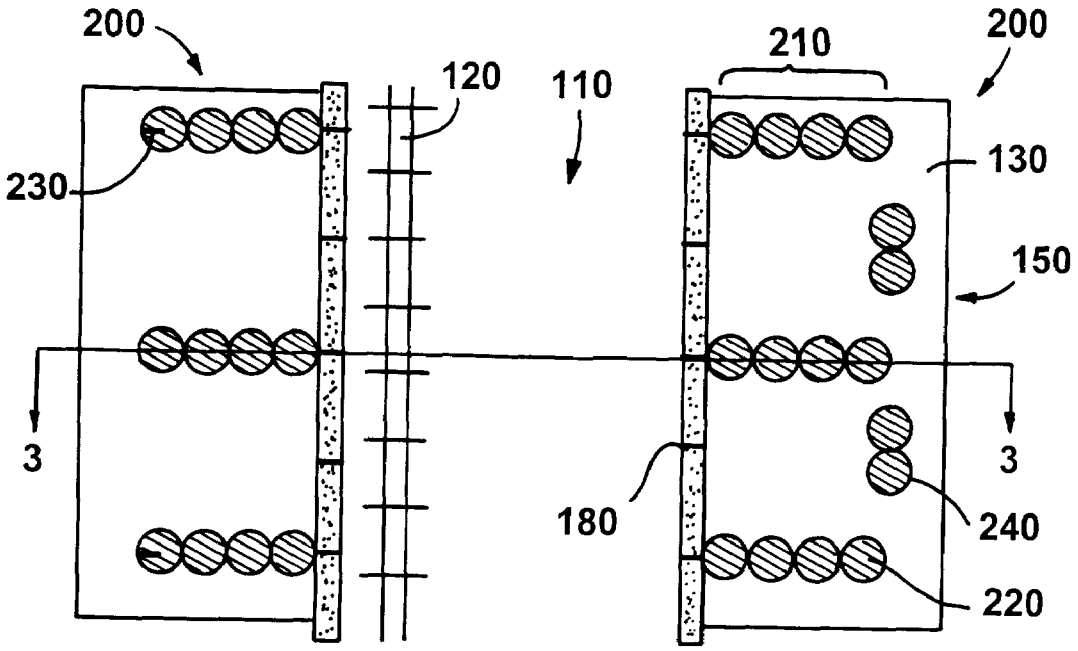
FIG. 4 is an overhead sectional view of the excavation support structure of FIG. 3, along section 4—4 of FIG. 3.
Figure 3:
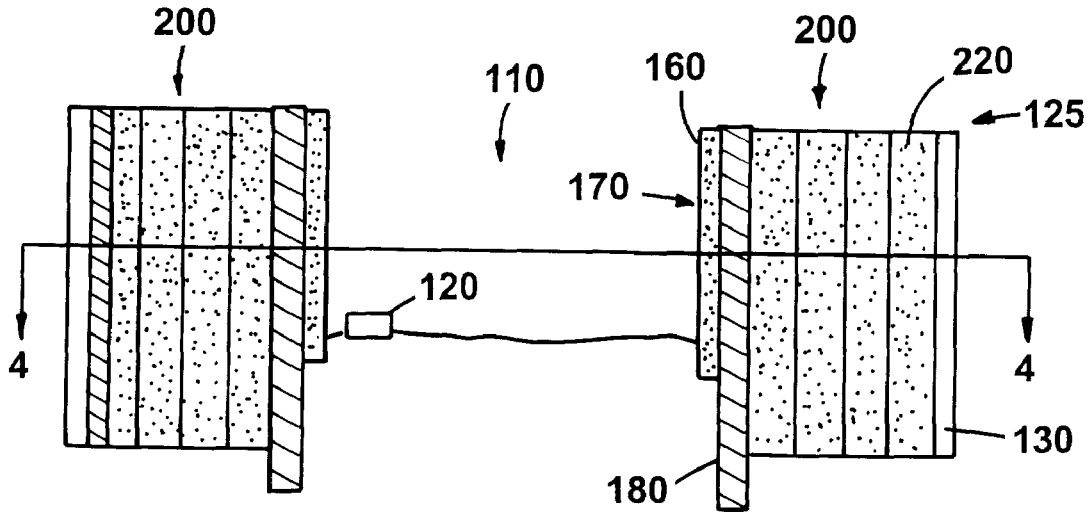
FIG. 3 is a sectional view of an excavation support structure employing wall stems.

FIGS. 3 and 4 illustrate an alternative arrangement of the soil-cement columns in a support structure 200. As shown, wall stems 210 are formed with perpendicular rows of round soil-cement columns 220 on the unexcavated side of the wall. To form a composite gravity wall structure, as described above, the spacing of the wall stems 210 is such that the replacement ratio is approximately 25% or greater. A lower replacement ratio may be used. However, with a replacement ratio of less than 25%, the wall stems will serve essentially as counterforts, rather than as part of a composite gravity wall structure. Counterforts provide lateral support to the inside wall facing, but do not take full advantage of the mass of the untreated soil. Additional soil-cement columns 240 may be placed between the wall stems 210 to provide the required replacement ratio for a composite gravity wall.

Metal reinforcement rods or beams 230 may be inserted into some or all of the soil-cement columns 220 to improve tensile load bearing capabilities of the support structure. In the stem arrangement of FIGS. 3 and 4, this reinforcing metal is typically placed in the column furthest from the inside face of the wall to provide tensile reinforcement for the gravity wall and provide moment carrying capacity for the permanent wall 160. Reinforcing metal may be placed in all elements or only those deemed important for tensile load carrying capacity.

Figure 5:
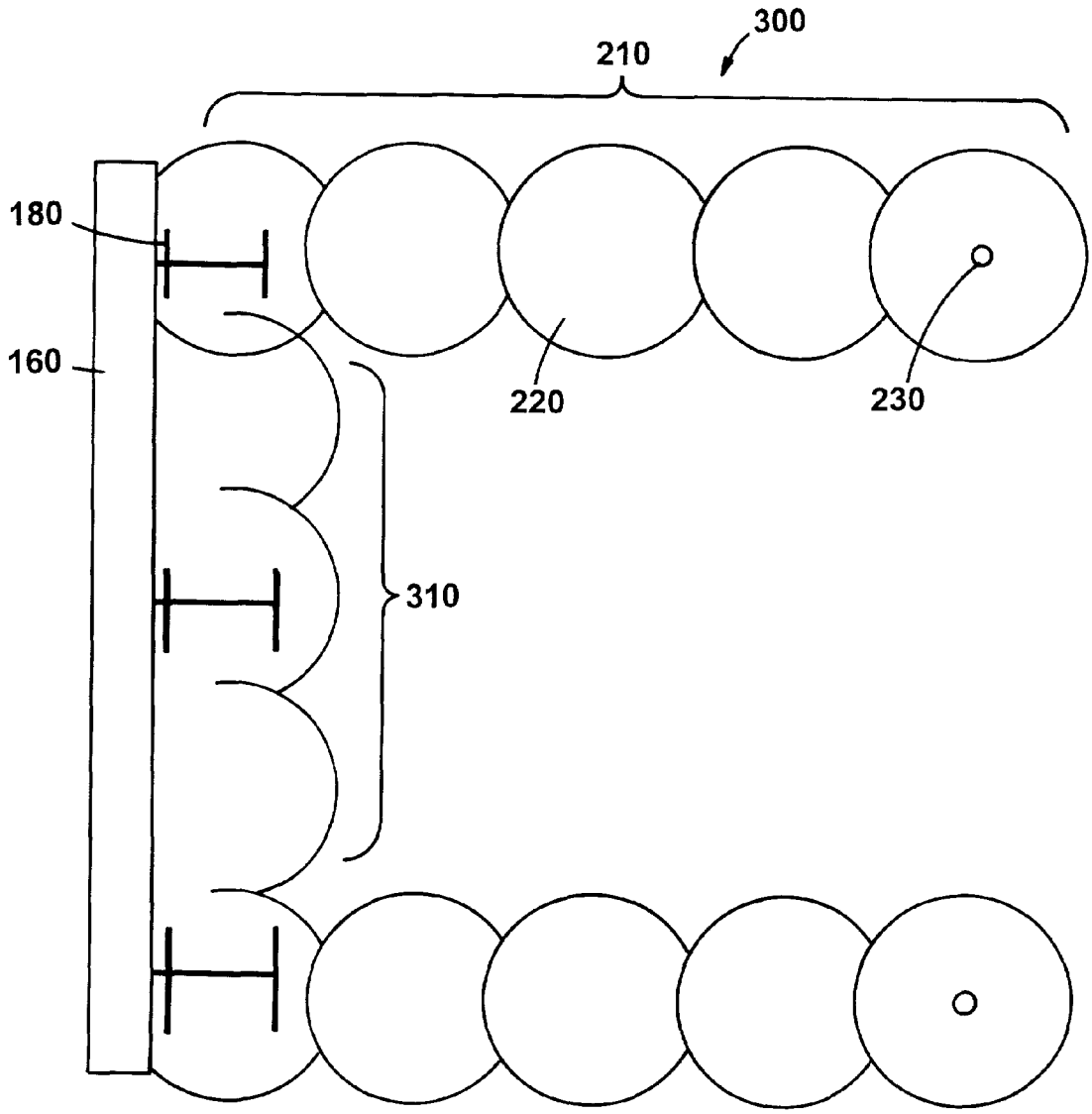
FIG. 5 is an overhead sectional view of an excavation support structure employing wall stems and additional columns along the inside face.

FIG. 5 illustrates an excavation support structure 300 that includes wall stems 210 formed from rows of soil-cement columns 220 and an overlapping row 310 of soil-cement columns along the inside surface of the permanent wall 160. The additional row of soil-cement columns 310 minimizes lateral forces and helps prevent water penetration through the wall 160. In instances where water penetration is not a concern, a non-overlapping row of soil-cement columns may be used along the inside surface. This configuration also includes metal reinforcing rods 230 inserted into selected soil-cement columns to provide addition tensile support.

Figure 6:
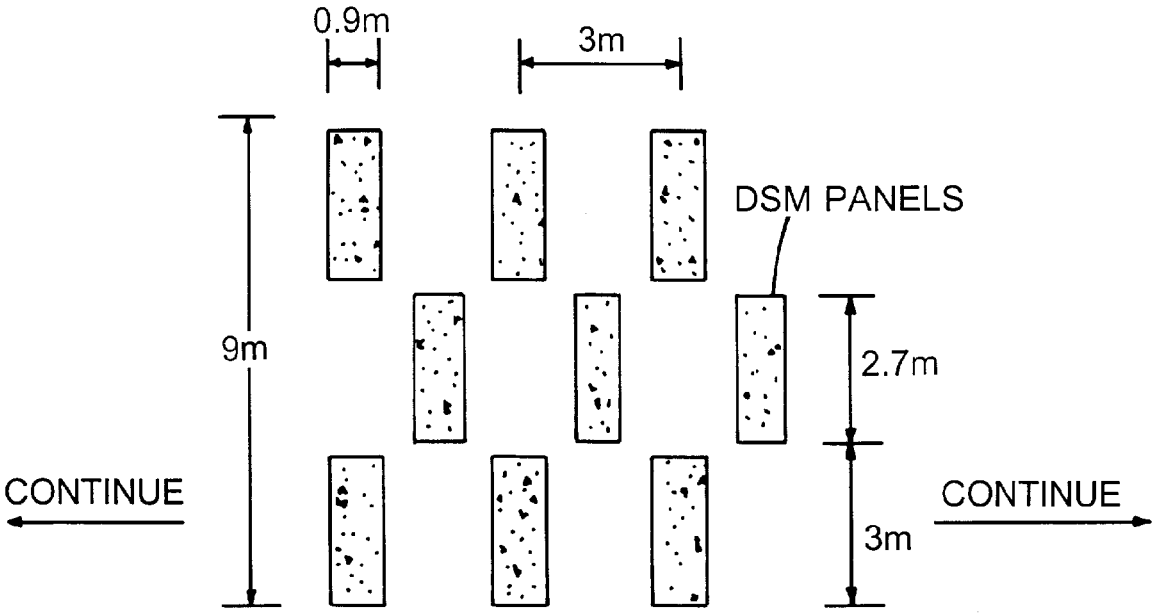
FIG. 6 is a plan view of a staggered column configuration of DSM elements.
Figure 7:
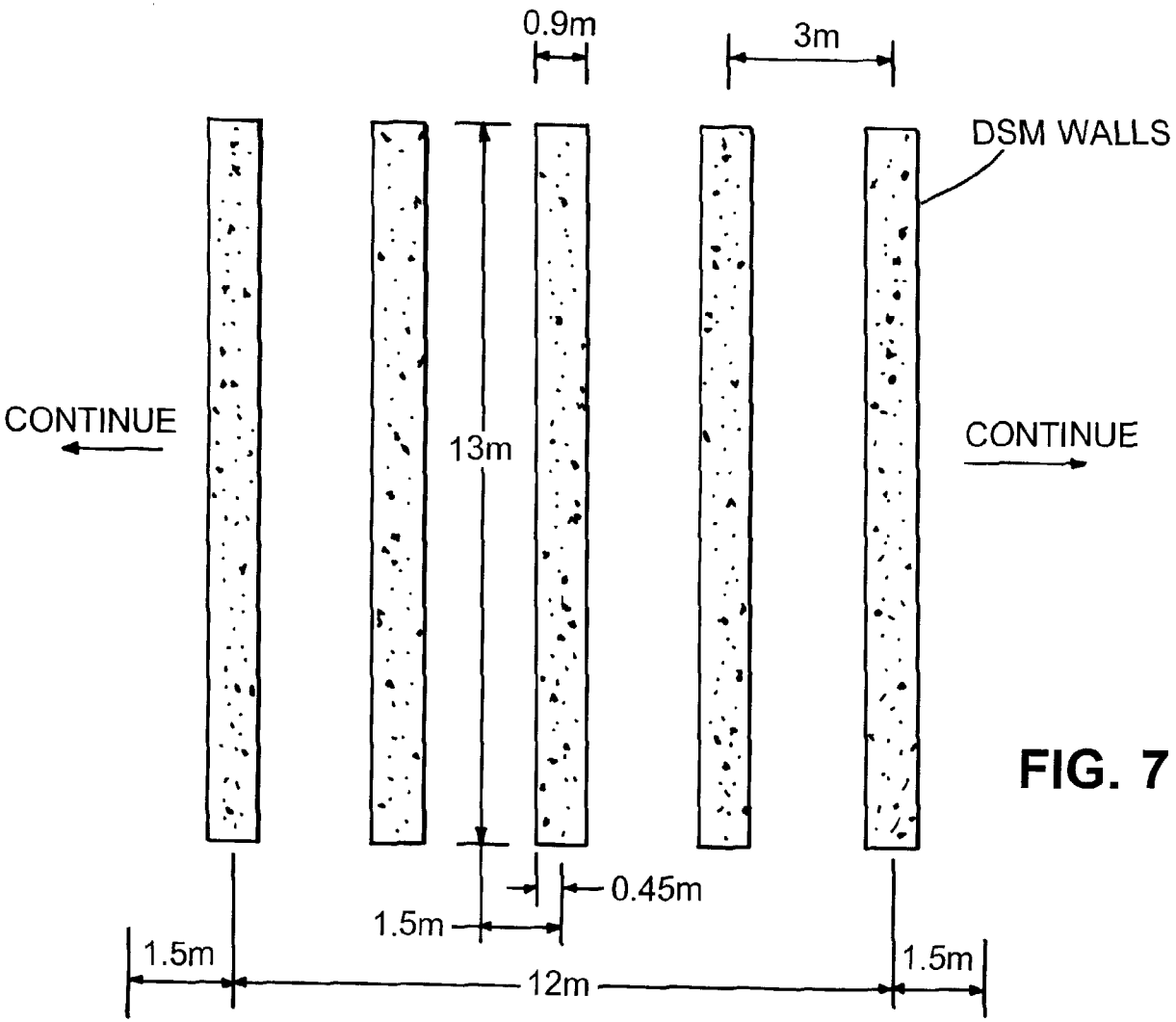
FIG. 7 is a plan view of a parallel wall configuration of DSM elements.

To assess the composite action of DSM elements (such as soil-cement columns or soil-cement walls) and the untreated soil surrounding these elements, horizontal slice, finite element analyses were performed for two configurations of DSM elements. The first configuration, as shown in FIG. 6, is an arrangement of staggered rows of rectangular soil-cement columns measuring approximately 0.9 meters by 2.7 meters. The rows are spaced about 3 meters apart, and the columns within each row are spaced about 0.3 meters apart. The second configuration, as shown in FIG. 7, is an arrangement of parallel DSM walls measuring approximately 3 meters by 13 meters, spaced about 3 meters apart.

An important parameter of the support structure is the replacement ratio, which is the ratio of the volume of the DSM elements to the total volume of the support structure. In most instances, this ratio may be calculated from an area ratio from a plan view of the support structure. For example, for the configuration shown in FIG. 7, the replacement ratio can be determined from a 1.5 meter by 13 meter strip of the plan area extending from the center line of a wall element to a point half way between two wall elements (taking the symmetry of the structure into account):

$$RR = \frac{0.45\ \text{m} \times 13\ \text{m}}{1.5\ \text{m} \times 13\ \text{m}} = 0.3$$

In other instances, such as for irregular DSM element spacings, it may be necessary to consider the total plan area or the total volume of the DSM elements and the support structure. The total area or volume of the support structure may be thought of as extending to edges of the outside DSM elements. Alternatively, the total area or volume of the support structure may be thought of as extending beyond the edges of the outside DSM elements by a distance equal to one half the spacing between DSM elements. For example, referring again to FIG. 7, the replacement ratio may be calculated by the following:

$$RR = \frac{0.9\text{ m} \times 13\text{ m} \times 5}{(12\text{ m} + 2(1.5\text{ m})) \times 13\text{ m}} = 0.3$$

The purpose of the finite element analyses was to determine the horizontal pressure required to extrude soil between the DSM elements without consideration of the load carrying capacity of the DSM elements. In other words, to determine at what point a composite structure of soil-cement columns would fail due to soil shifting between the columns, as opposed to failure of the columns themselves. The analyses were performed using finite element analysis software that models structural members by dividing them into a "mesh" of smaller elements.

Figure 8:
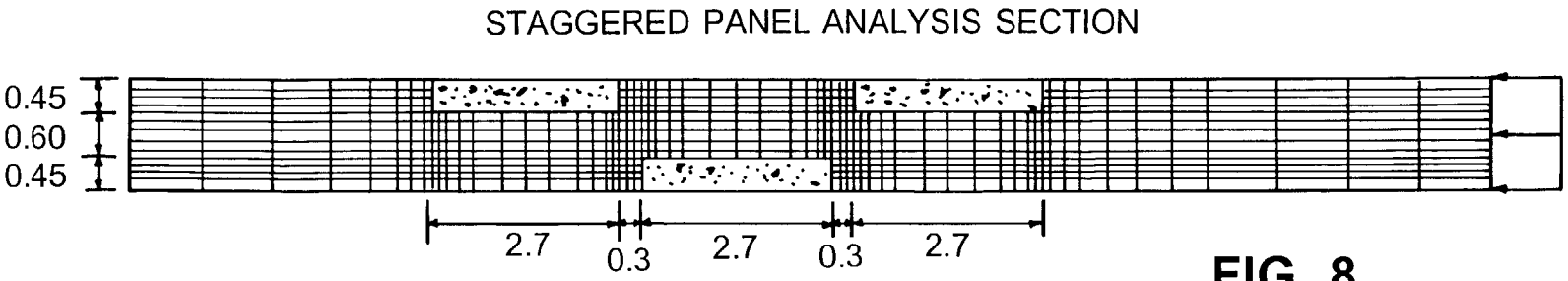
FIG. 8 is a plan view of a finite element analysis mesh for a staggered column configuration.
Figure 9:
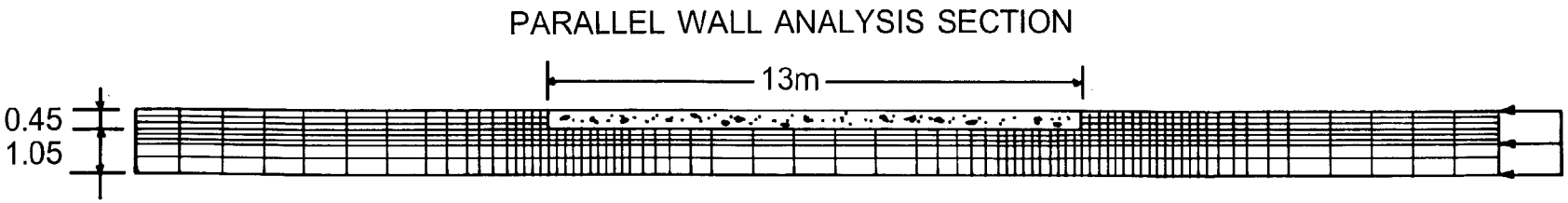
FIG. 9 is a plan view of a finite element analysis mesh for a parallel wall configuration.

The meshes used for analysis of the parallel wall and staggered column configurations are shown in FIGS. 8 and 9. Due to symmetry, only a 1.5 meter wide strip was needed to be analyzed for either configuration. The analyses were made by holding the nodes at the location of the DSM elements fixed and extruding soil past the DSM elements. Roller boundary conditions were used for the nodes along the lines of symmetry. The nodes on either end of the analysis strips were unconstrained, and interface elements were used between the DSM elements and the soil elements to allow slippage at these locations. The strength of the interface elements was set equal to the strength of the soil, which is a reasonable model because the soil would ordinarily be well bonded to the DSM elements.

Figure 10:
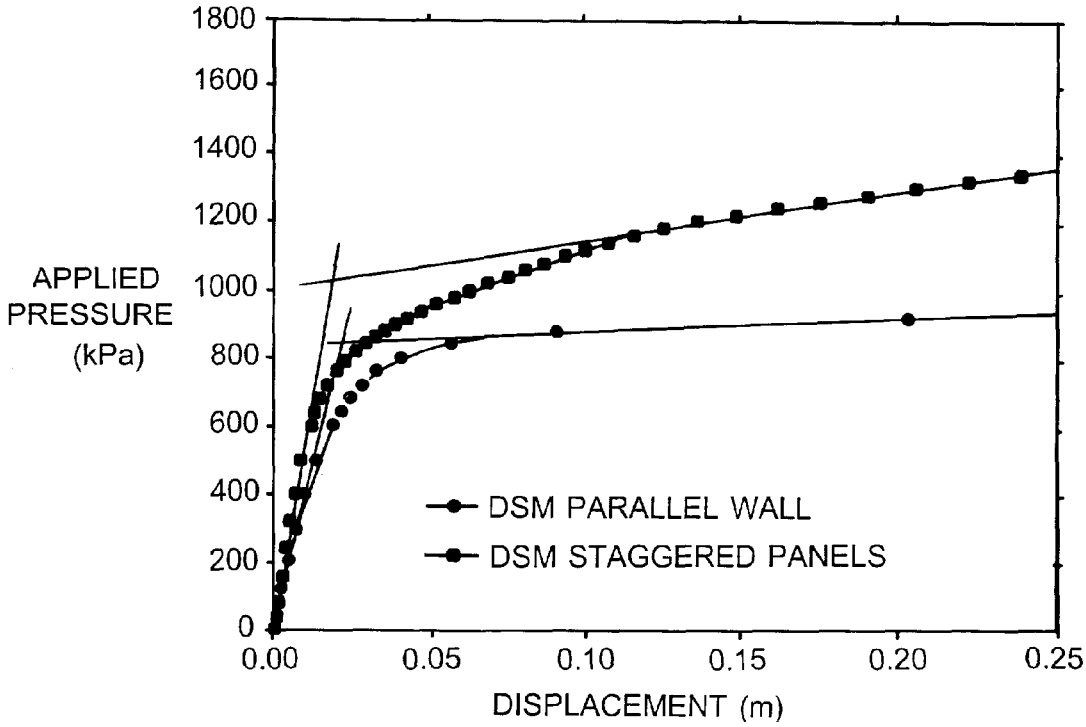
FIG. 10 is a plot of the results of a horizontal slice, finite element analysis for two DSM element configurations.

The finite element analysis results for the parallel wall and staggered column arrangements are shown in FIG. 10. The pressure required to extrude soil between the DSM elements was 850 kPa for the parallel wall configuration and 1030 kPa for the staggered column configuration. More pressure is required to extrude soil between the staggered columns than between the parallel walls because of the greater frontal surface area of the columns versus the parallel walls, which have only a single front surface per row.

The horizontal slice analyses described above provide estimates of the pressure required to extrude soil past the DSM walls or panels. To completely assess composite action, the structure of the DSM elements in the vertical plane and the strength of the DSM elements are also considered. The fundamental question regarding composite action of DSM elements and the surrounding soil is, whether, as the soil is pushed toward the DSM elements by an embankment load, the soil will extrude past the DSM elements with the DSM elements remaining intact or a shear surface will form through both the soil and the DSM elements. If the soil is more likely to extrude past the DSM elements, then composite action is not occurring at ultimate loads, i.e. loads that cause failure of the support structure. If it is more likely that a shear surface will develop through both the soil and the DSM elements, then composite action is occurring at ultimate loads. Composite action is less likely when the soil strength is low, the DSM strength is high, and the DSM elements are spaced widely apart.

Figure 11:
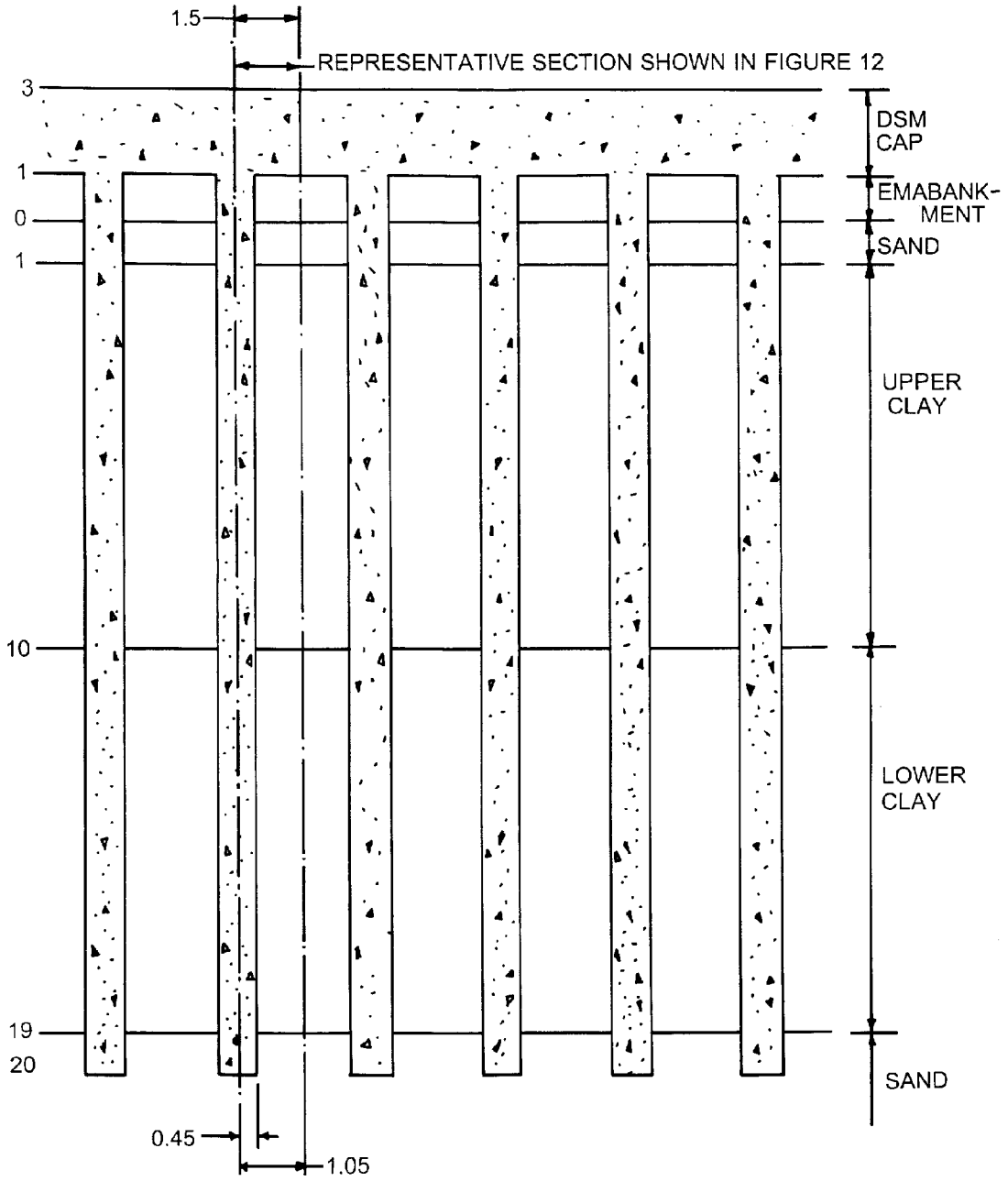
FIG. 11 is a vertical cross-section of a parallel wall configuration with a DSM cap structure.
Figure 12:
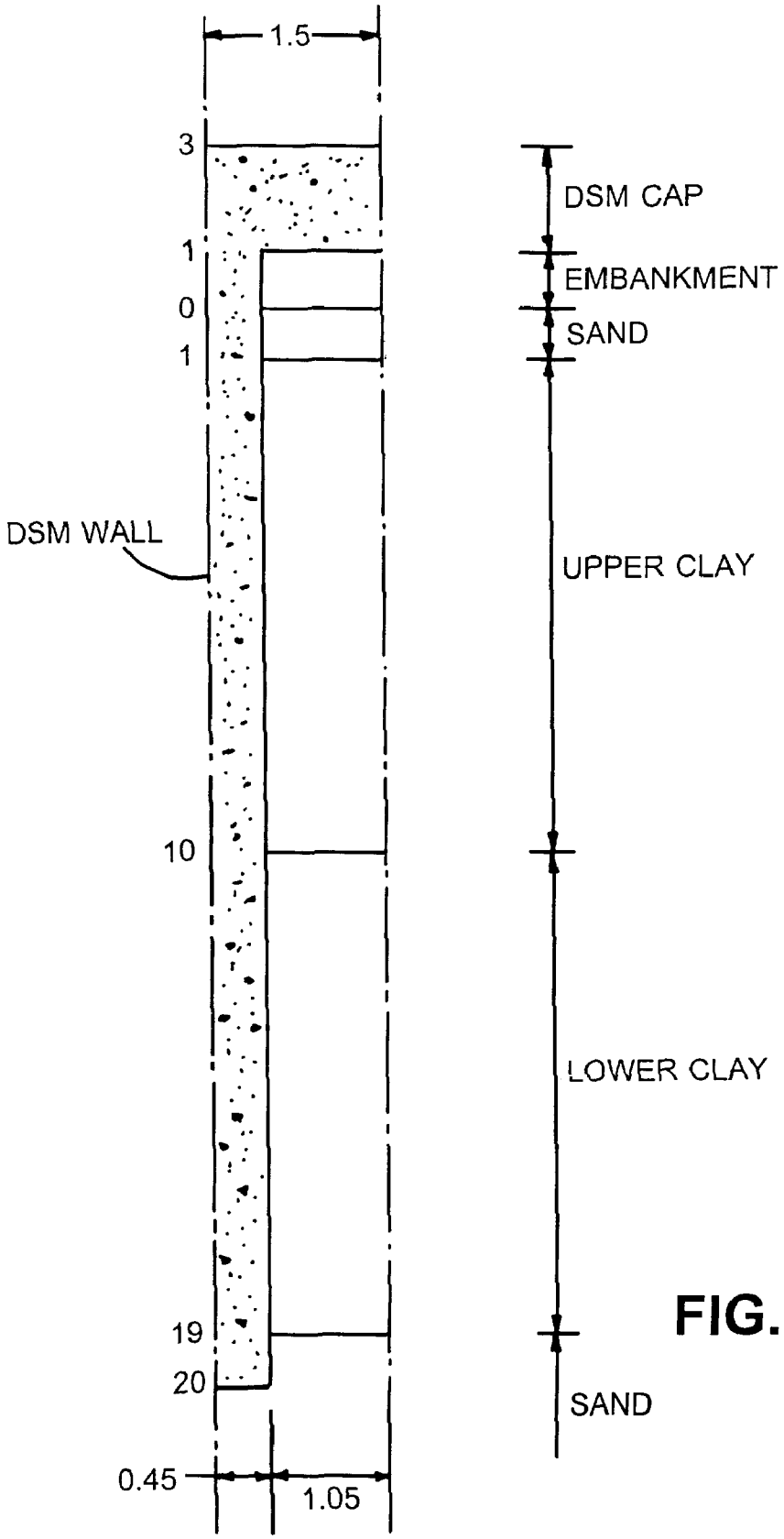
FIG. 12 is a vertical cross-section of a 1.5 meter wide section of a parallel wall configuration.
Figure 13:
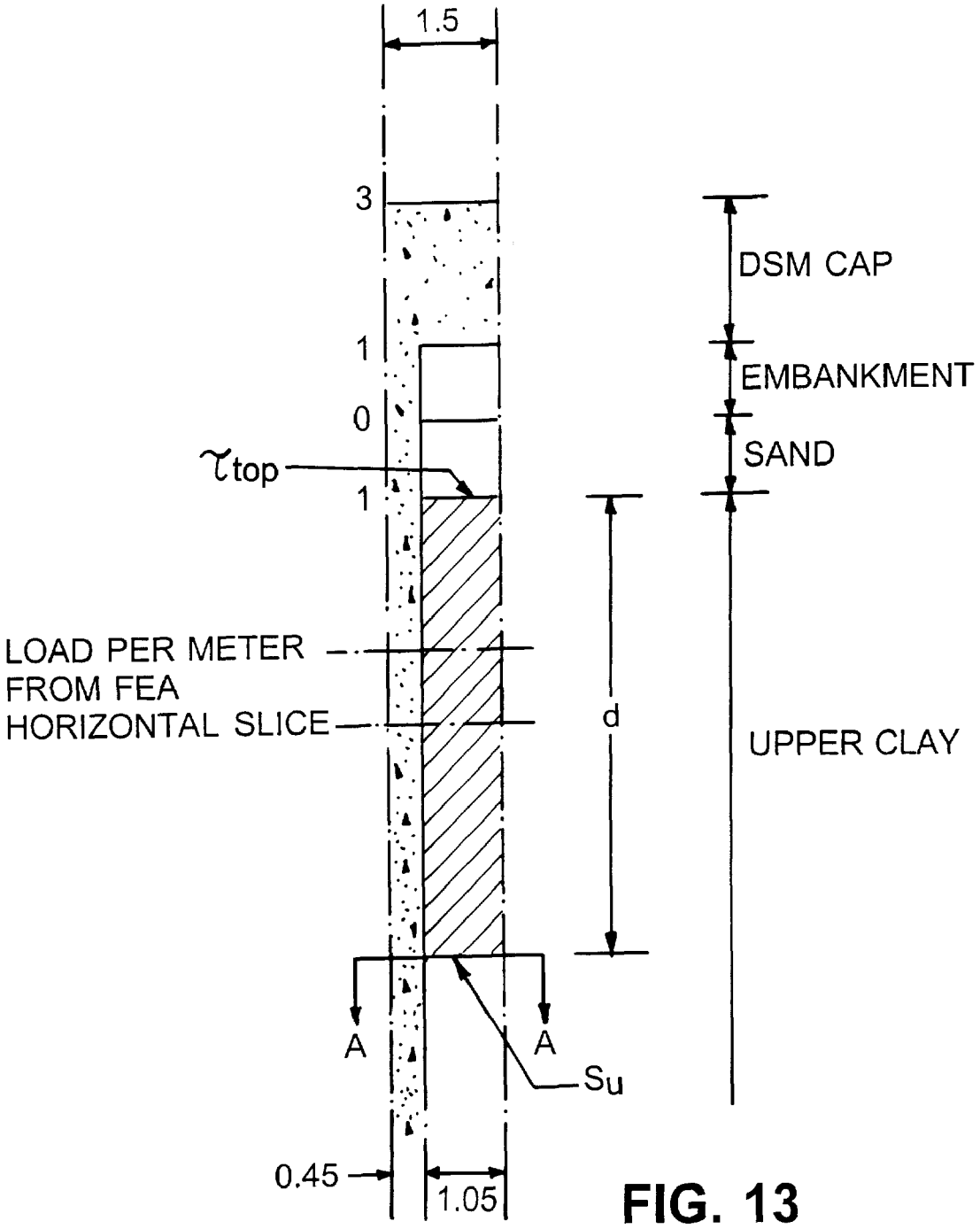
FIG. 13 is a vertical cross-section of a 1.5 meter wide section of a parallel wall configuration showing an area of soil to be extruded between the DSM elements.

FIG. 11 shows a longitudinal section through the parallel wall DSM configuration positioned in a soil profile that includes sand and clay layers. The center-to-center wall spacing is 3 meters. Due to symmetry, a representative 1.5 meter portion of the longitudinal section can be used for analysis, as shown in FIG. 12. FIG. 13 shows a shaded zone of upper soil that could be extruded between the DSM walls. The composite shear strength that can be mobilized on plane AA, shown in FIG. 14, is the lesser of: the weighted average of the full shear strength of the soil and the full shear strength of the DSM element (mode 1 or composite shear mode); or the weighted average of the full shear strength of the soil and the shear stress induced in the DSM element during soil extrusion (mode 2 or extrusion mode).

Figure 14:
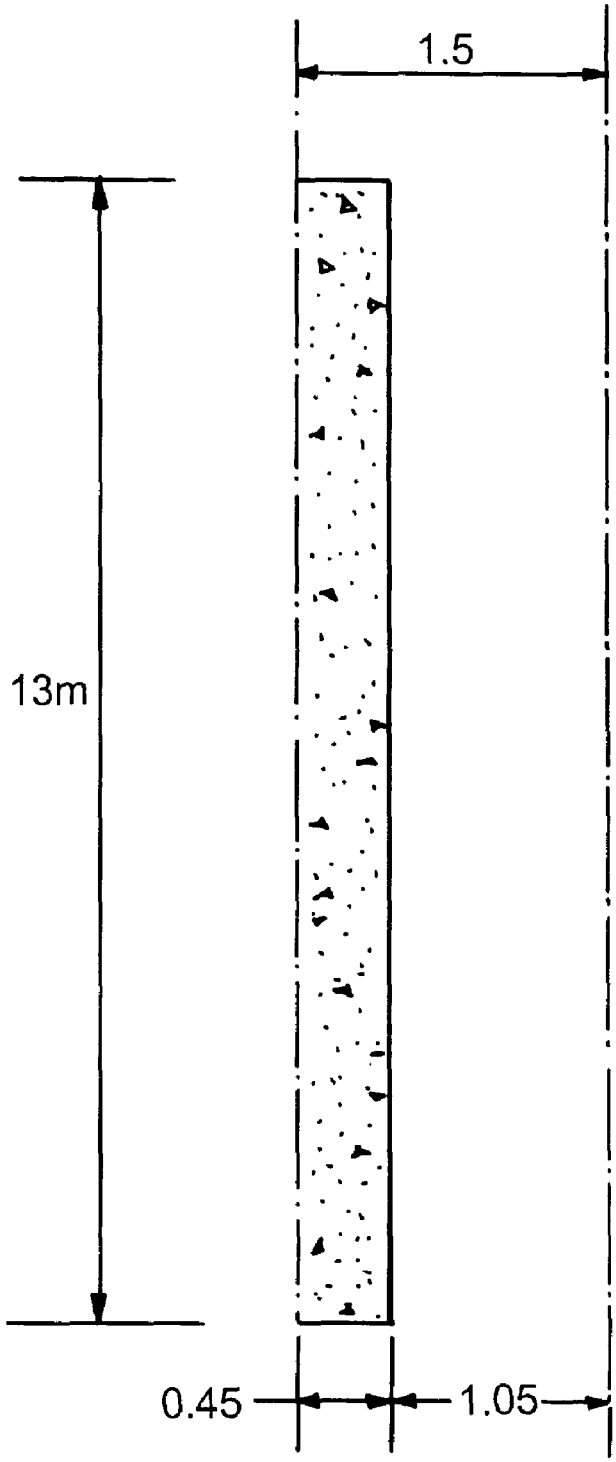
FIG. 14 is a plan view of a 1.5 meter wide section of a parallel wall configuration.

In mode 1, the area ratio for the configuration shown in FIG. 14 is 0.3, so the composite strength according to mode 1 is given by:

$$s_{u_1} = 0.3 s_{u_{wall}} + 0.7 s_{u_{soil}}$$

If $s_{uwall}$ equals 600 kPa and $s_{usoil}$ equals 58 kPa, then $s_{u1}$ equals 221 kPa.

Figure 15:
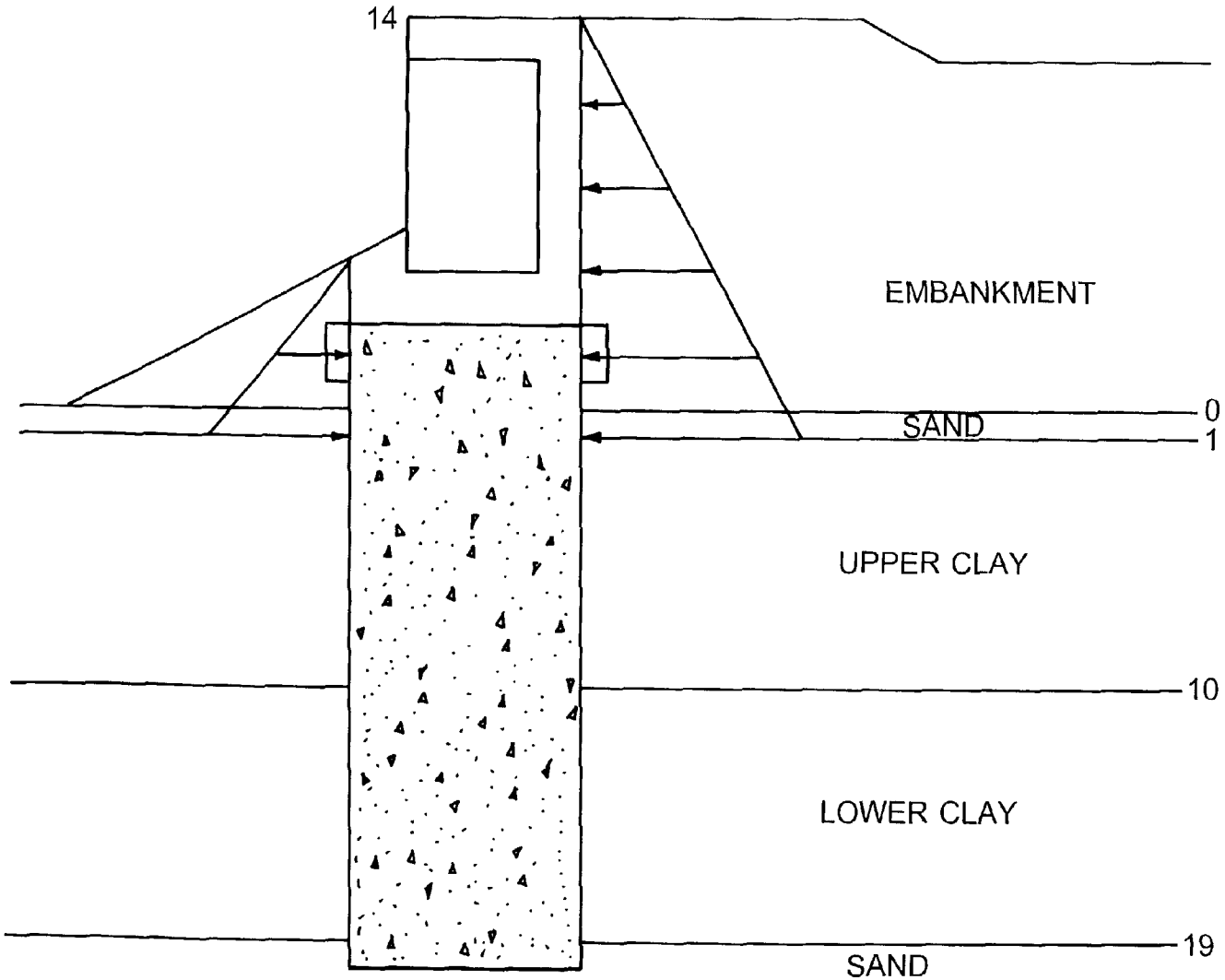
FIG. 15 is a transverse cross-section of DSM elements below an embankment.

In mode 2, the stress in the DSM element at the level of plane AA is a combination of the net lateral loads above the top of the upper clay layer, shearing between the sand and the clay at the top of the shaded zone, and the load per meter of clay thickness from the horizontal slice analyses times the thickness, d, of the clay to be extruded. The net lateral loads above the top of the upper clay layer can be estimated using lateral earth pressure concepts. A sketch of the transverse section used in this analysis is shown in FIG. 15. On the active side, if the active earth pressure coefficient of the embankment is 0.27, the unit weight is 21.2 kN/m$^3$, and the height is 15 meters, then the active earth force is 966 kN for a 1.5 meter wide vertical slice. On the passive side, considering the 2H:1V slope, the passive earth pressure coefficient may be about 1.39, and the at-rest earth pressure coefficient may be about 0.24 (according to the Danish code formula). The actual value of the lateral earth pressure coefficient on the passive side depends on the amount of lateral movement. Taking an intermediate value of lateral movement of 0.8, a unit weight of 21.2 kN/m$^3$, and a height of 6.5 meters, then the lateral earth force an the passive side is 537 kN for a 1.5 meter wide vertical slice. Therefore, the net lateral force is the difference between 966 kN and 537 kN or 430 kN.

The smaller the load carried by the DSM element at the level of Section AA when extrusion of the soil initiates, the less the total resistance that can be mobilized at that level. Consequently, it is conservative to assume that there is active lateral pressure, because it corresponds to the lowest total resistance that can be mobilized against overall stability failure. If the less conservative assumption of at-rest lateral earth pressure is applied on the active side of the embankment, above the top of the upper clay layer (using an at-rest lateral earth pressure coefficient of 0.43), then the net lateral force above the top of the clay layer would be the difference between 1537 kN and 537 kN, or 1000 kN.

The load from shearing between the clay and sand layers at the top of the shaded zone in FIG. 13 is given by:

$$L = (1.05\text{ m})\ (13\text{ m})\tau_{top}$$

Where L is the load from shearing at the top of the upper clay layer. If $\tau_{top}$ is conservatively taken to be zero, then this component of load in the DSM walls equals zero. A less conservative assumption would be that $\tau_{top}$ equals the strength of the upper clay layer or 58 kPa. In that case, the load from shearing at the top of the upper clay would be 792 kPa.

The load to extrude soil between the DSM walls above section AA and below the top of the upper clay layer can be calculated by multiplying the pressure from horizontal slice calculations for a 1 meter thick horizontal slice by the frontal area of the extruded zone (1.5 meters multiplied by the height, d). The load calculated in this manner includes both the shear stress along the sides of the DSM walls and the bearing pressure on the leading edge of the DSM walls. The extrusion pressure from the horizontal slice calculations for the DSM walls in the upper clay layer is 850 kPa. Using an extruded zone 2 m thick as an example yields:

$$L = (850\text{ kPa})(1.5\text{ m})d = (850\text{ kPa})(1.5\text{ m})(2\text{ m})$$

$$= 2{,}550\text{ kN}$$

where L equals the load required to extrude the clay between the DSM elements.

Thus, for these conditions, the total load transferred into the DSM wall at section AA at the onset of extrusion is 430+0+2,550=2,980 kN according to the conservative assumptions and 1,000+792+2,550=4,342 kN according to the less conservative assumptions. Thus, the mobilized shear strength, $\tau_{DSM}$, in the DSM wall at section AA is (2,980 kN)/(0.45 m)(13 m)=509 kPa according to the conservative assumptions and (4,342 kN)/[(0.45 m) (13 m)]=742 kPa according to the less conservative assumptions.

Therefore, the strength that can be mobilized on plane AA according to mode 2 (extrusion) for the conservative assumptions is given by:

$$s_{u_2} = 0.3\tau_{DSM} + 0.7s_{u_{clay}}$$

$$= 0.3(509\text{ kPa}) + 0.7(58\text{ kPa}) = 193\text{ kPa}$$

The strength that can be mobilized on plane AA according to mode 2 for the less conservative assumptions is given by:

$$s_{u_2} = 0.3\tau_{DSM} + 0.7s_{u_{clay}}$$

$$= 0.3(742\text{ kPa}) + 0.7(58\text{ kPa}) = 263\text{ kPa}$$

The critical failure mode is determined by comparing the mode 1 and mode 2 results as shown in the table below. For the conservative assumptions, the critical failure mode is mode 2, and the strength that can be mobilized on plane AA is 193 kPa. For the less conservative assumptions, the critical failure mode is mode 1, and the strength that can be mobilized on plane AA is 221 kPa. The table also presents the results for d=3 meters. It can be seen that the larger the block of extruded soil, the more likely it is that mode 1 (composite shear) will control.

| | Strength That Can Be Mobilized on Plane AA (kPa) | | | | | |
|---|---|---|---|---|---|---|
| | Conservative Assumptions | | | Less Conservative Assumptions | | |
| Thickness, d (m) | Mode 1, Composite Shear | Mode 2, Extrusion | Critical Mode | Mode 1, Composite Shear | Mode 2, Extrusion | Critical Mode |
| 2 | 221 | 193 | 193 | 221 | 263 | 221 |
| 3 | 221 | 259 | 221 | 221 | 329 | 221 |

Figure 16:
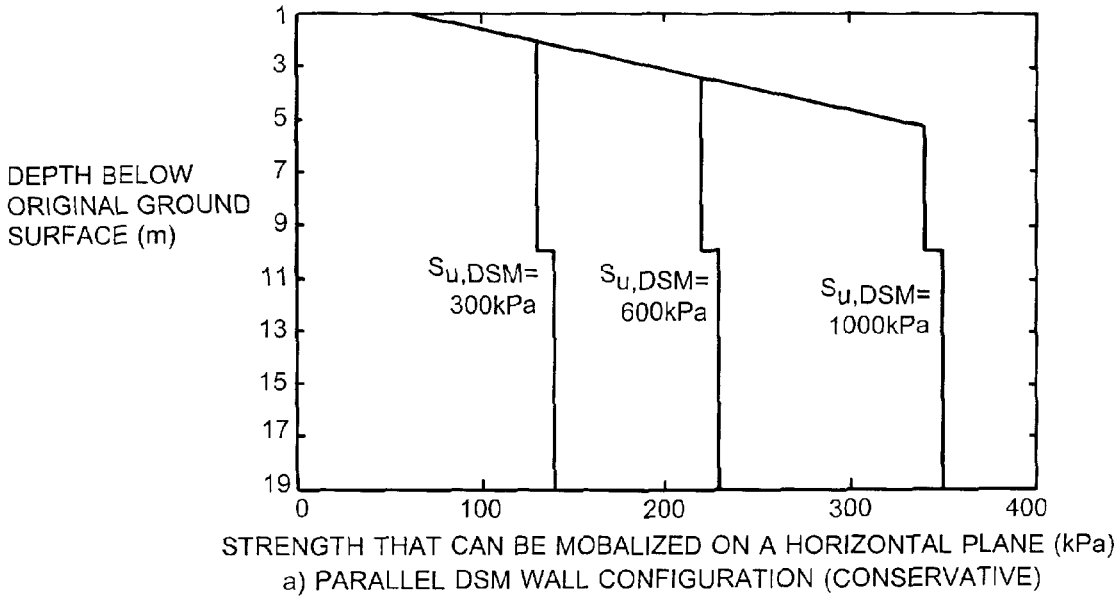
FIG. 16 is a plot of strength that can be mobilized on a horizontal plane for the parallel wall configuration with conservative assumptions.
Figure 17:
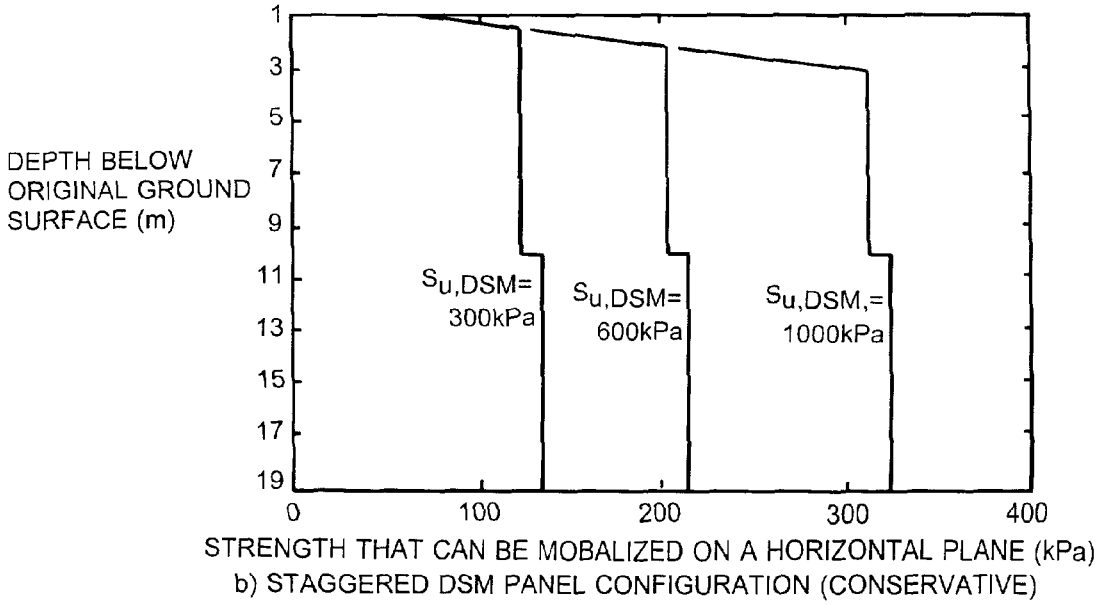
FIG. 17 is a plot of strength that can be mobilized on a horizontal plane for the staggered column configuration with conservative assumptions.
Figure 18:
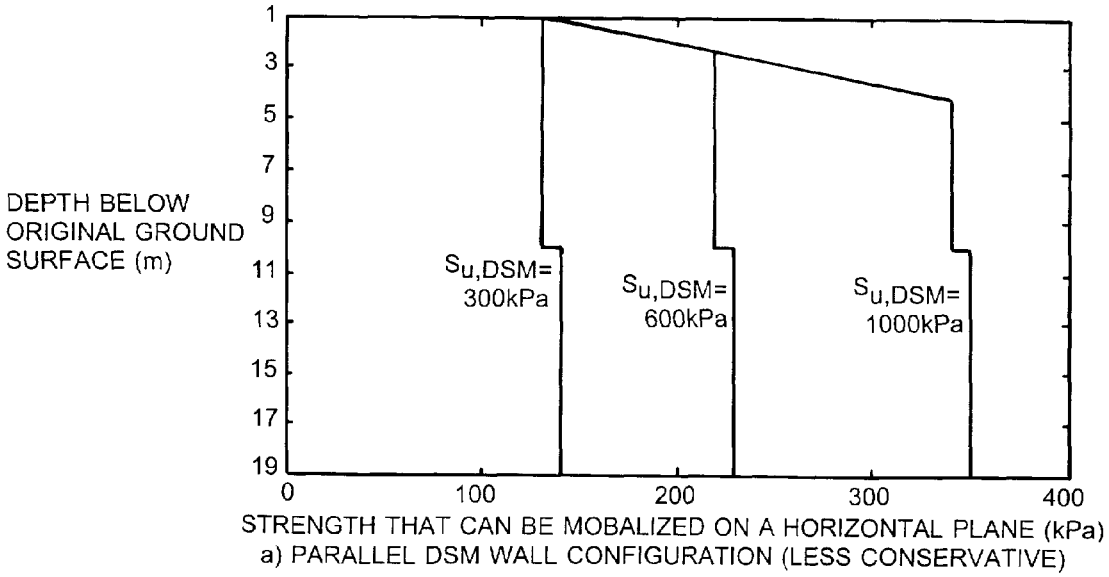
FIG. 18 is a plot of strength that can be mobilized on a horizontal plane for the parallel wall configuration with less conservative assumptions.
Figure 19:
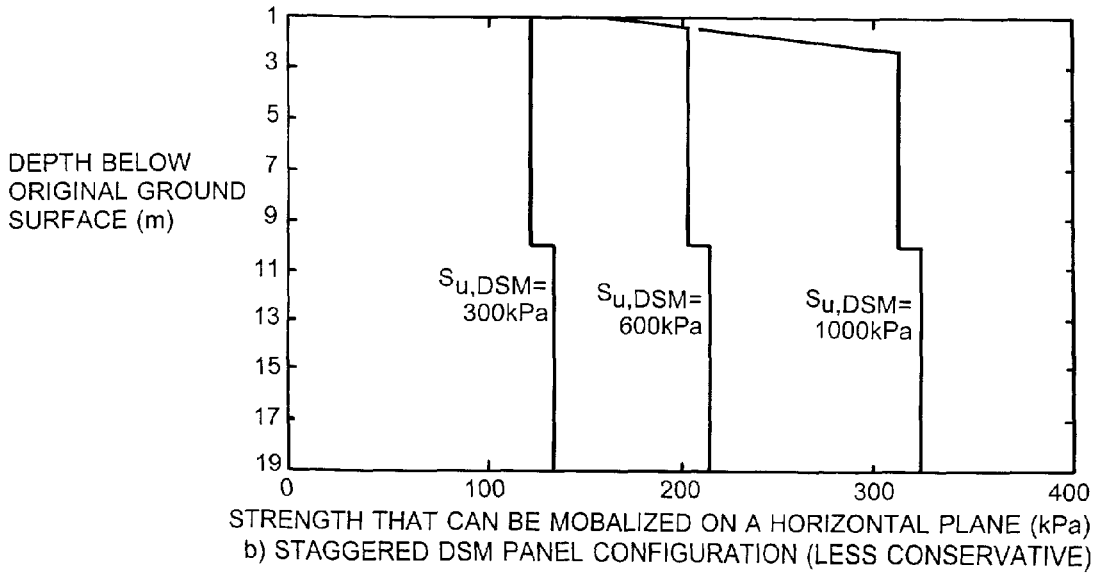
FIG. 19 is a plot of strength that can be mobilized on a horizontal plane for the staggered column configuration with less conservative assumptions.
Figure 20:
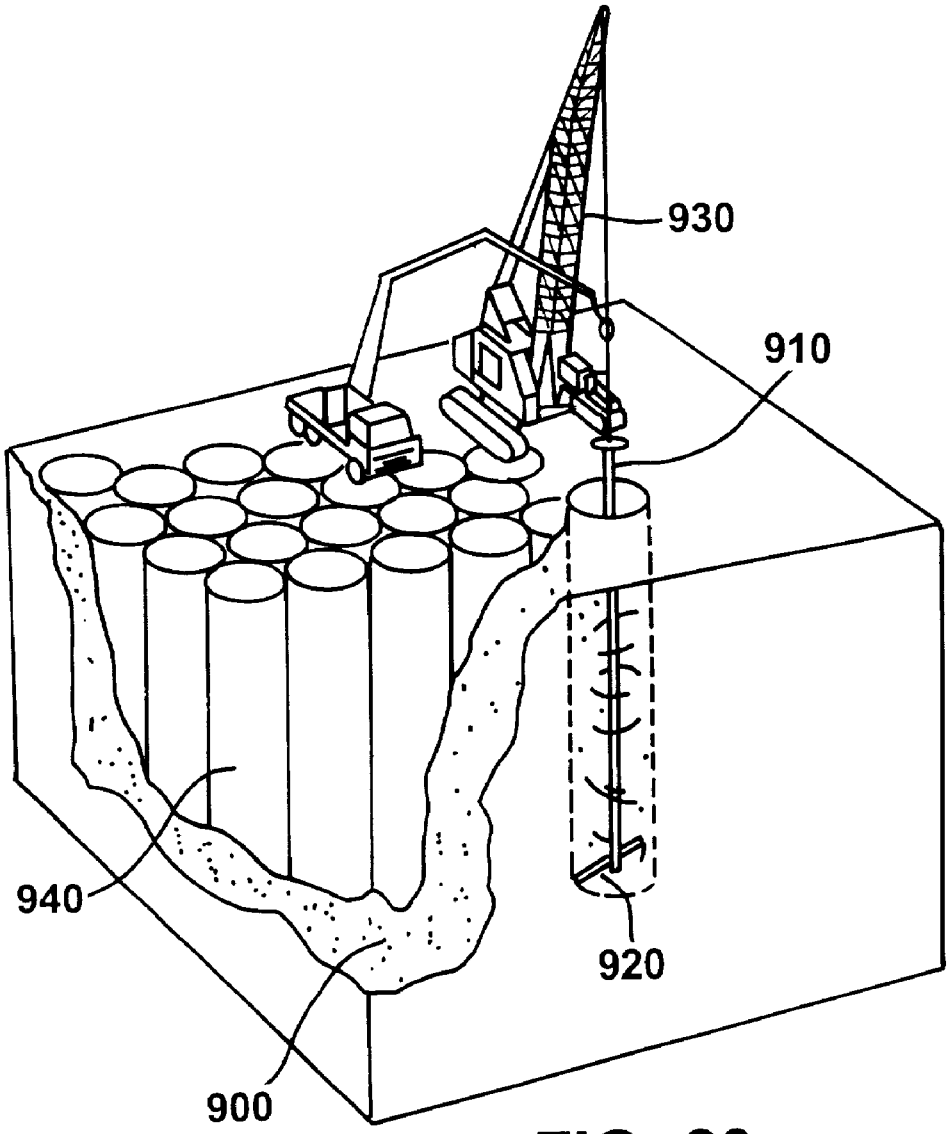
FIG. 20 is a cutaway view of a technique for forming in situ soil-cement columns.

The procedures described above were applied to the continuous DSM wall geometry and to the staggered DSM column geometry using both the conservative and the less conservative assumptions described above. In all cases, values of $s_{uDSM}$ equal to 300, 600, and 1,000 kPa were used. The resulting composite shear strengths are shown in FIGS. 16–19. As shown in FIGS. 16–17, the results for the conservative assumptions indicate that mode 2 (extrusion) controls in the upper portion of the upper soil layer. The thickness of the upper soil controlled by extrusion increases as the DSM strength increases. Also, the thickness controlled by extrusion is greater for the continuous wall arrangement than it is for the staggered panel arrangement. The results for the less conservative assumptions, as shown in FIGS. 18–19, indicate that extrusion controls the available strength to greater depths when the more conservative assumptions are employed. These results are summarized in the table below. The values of extrusion-controlled (mode 2) strength and the depths at which this mode controls were used in the analysis of the overall slope stability.

| | Continuoue Walls | | | Staggered Panels | | |
|---|---|---|---|---|---|---|
| $S_u$, DSM (kPa) | Extrusion Controlled Composite Strength at Top of Upper Clay (kPa) | Thickness of Upper Clay Below Which Extrusion No Longer Controls (m) | Full Composite Strength in the Upper Clay Layer Below the Extrusion-Controlled Thickness (kPa) | Extrusion Controlled Composite Strength at Top of Uper Clay (kPa) | Thickness of Upper Clay Below Which Extrusion No Longer Controls (m) | Full Composite Strength in the Upper Clay Layer Below the Extrusion Controlled Thickness (kPa) |
| | | | a) Conservative Assumptions | | | |
| 300 | 63 | 1.0 | 131 | 74 | 0.4 | 123 |
| 600 | 63 | 2.4 | 221 | 74 | 1.1 | 204 |
| 1000 | 63 | 4.2 | 341 | 74 | 2.1 | 312 |
| | | | b) Less Conservative Assumptions | | | |
| 300 | 132 | 0.0 | 131 | 159 | 0.0 | 123 |
| 600 | 132 | 1.3 | 221 | 159 | 0.4 | 204 |
| 1000 | 132 | 3.2 | 341 | 159 | 1.3 | 312 |

Slope stability analyses were performed using Spencer's method as implemented by computer software and are shown in the table below. Analyses were performed for cases in which only mode 1 (composite shear) was allowed and cases in which mode 2 (extrusion) was permitted. The analysis results are summarized in the table below. For the conservative assumptions, mode 1 controls when the DSM shear strength is 300 kPa, and mode 2 controls when the DSM shear strength is 600 kPa and 1,000 kPa. The transition occurs at a DSM element strength of about 380 kPa for the parallel walls and about 550 kPa for the staggered columns. For the less conservative assumptions with the parallel walls, mode 1 controls when the DSM element strength is 300 kPa and 600 kPa, and mode 2 controls when the DSM strength is 1,000 kPa. The transition occurs at a DSM element strength of about 940 kPa. For the less conservative assumptions with the staggered columns, mode 1 controls for all three DSM element strengths analyzed.

In general, the less conservative set of assumptions is more realistic than the conservative set of assumptions because the DSM element, will together comprise a relatively stiff system that will attract load. When the less conservative assumptions are employed, composite shear through both the DSM and the soil controls for all cases except for the parallel walls with a DSM strength of 1,000 kPa. For this exceptional case, the safety factor is very high, 2.37. Therefore, at working stresses, the DSM walls and the soil can still be considered to act in a composite fashion.

From the results of this analysis, it is possible to determine the minimum DSM element strength necessary to achieve a desired factor of safety. For example, if the required minimum factor of safety is 1.5 for the staggered column arrangement, a DSM element strength of approximately 420 kPa is required. If the required minimum factor of safety is 1.5 for the parallel wall configuration, a minimum DSM element strength of 300 kPa would be sufficient.

| $S_u$, DSM | Factor of Safety | |
|---|---|---|
| (kPa) | Parallel DSM Walls | Staggered DSM Panels |
| 300 | 1.55 | 1.38 |
| 600 | 2.02 | 1.69 |
| 1000 | 2.37 | 2.08 |

Slope Stability Analysis Results

| DSM Configuration | DSM Undrained Shear Strength (kPa) | Mode 1, Composite Shear: Composite Shear Strength (kPa) | Mode 1: Failure Surface Shape and Depth | Mode 1: Factor of Safety | Mode 2, Extrusion: Composite Shear Strength at Top of Clay (kPa) | Mode 2: Failure Surface Shape and Depth | Mode 2: Factor of Safety |
|---|---|---|---|---|---|---|---|
| a) Conservative Assumptions | | | | | | | |
| Parallel Walls | 300 | 131 | Circular, 9 m | 1.55 | 63 | Noncircular, 1 m | 1.67 |
| | 600 | 221 | Circular, 12.5 m | 2.02 | 63 | Noncircular, 1 m | 1.67 |
| | 1000 | 341 | Circular, 21 m | 2.43 | 63 | Noncircular, 1 m | 1.67 |
| Staggered Panels | 300 | 123 | Circular, 9 m | 1.38 | 74 | Noncircular, 1 m | 1.64 |
| | 600 | 204 | Circular, 9 m | 1.69 | 74 | Noncircular, 1 m | 1.64 |
| | 1000 | 312 | Circular, 9 m | 2.08 | 74 | Noncircular, 1 m | 1.64 |
| b) Less Conservative Assumptions | | | | | | | |
| Parallel Walls | 300 | 131 | Circular, 9 m | 1.55 | 132 | Noncircular, 1 m | 2.37 |
| | 600 | 221 | Circular, 12.5 m | 2.02 | 132 | Noncircular, 1 m | 2.37 |
| | 1000 | 341 | Circular, 21 m | 2.43 | 132 | Noncircular, 1 m | 2.37 |
| Staggered Panels | 300 | 123 | Circular, 9 m | 1.38 | 159 | Noncircular, 1 m | 2.25 |
| | 600 | 204 | Circular, 9 m | 1.69 | 159 | Noncircular, 1 m | 2.25 |
| | 1000 | 312 | Circular, 9 m | 2.08 | 159 | Noncircular, 1 m | 2.25 |

Overall, the analysis shows that for realistic assumptions, the DSM elements and the surrounding soil interact to form a composite structure. The composite shear mode (mode 1) controls for DSM element strengths below 940 kPa for the parallel wall configuration and 1000 kPa for the staggered column configuration. Composite parameters were used in a finite element analysis of a transverse section of a support structure. From this analysis, overall factors of safety were calculated for the two configurations, as shown in the table below.

Other embodiments are within the scope of the following claims.

What is claimed is:

1. An excavation support structure having a vertical face, the support structure comprising:

a plurality of staggered soil-cement columns positioned internal to the vertical face, the columns being positioned so that each of the columns is not connected by soil-cement to any other column, and soil surrounding the soil-cement columns except where the soil-cement columns meet the vertical face, wherein the soil-cement columns are positioned within the support structure so as to form a composite structure with the soil surrounding the soil-cement columns.

2. The excavation support structure of claim 1, wherein the soil-cement columns are distributed within the support structure so that failure due to formation of a shear surface occurs at a lesser applied force than failure due to extrusion of soil between the columns.

3. The excavation support structure of claim 1, wherein the vertical face is exposed.

4. The excavation support structure of claim 1, wherein the soil-cement columns are cylindrical.

5. The excavation support structure of claim 1, further comprising a wall constructed along the vertical face.

6. The excavation support structure of claim 5, wherein the wall is formed of concrete.

7. The excavation support structure of claim 5, wherein the wall is formed by a row of soil-cement columns.

8. The excavation support structure of claim 1, wherein a ratio of the volume of the columns to the total volume of the support structure is less than about 35%.

9. An excavation support structure having a vertical face, the support structure comprising:

a wall along the vertical face, and two or more rows of soil-cement columns perpendicular to and adjoining the wall, each row including at least two soil-cement columns, wherein the rows of soil-cement columns are surrounded by soil except where the rows adjoin the walls, and the soil-cement columns are positioned within the support structure so as to form a composite structure with the soil surrounding the soil-cement columns.

10. The excavation support structure of claim 9, wherein the soil-cement columns are distributed within the support structure so that failure due to formation of a shear surface occurs at a lesser applied force than failure due to extrusion of soil between the columns.

11. The excavation support structure of claim 9, wherein the vertical face is exposed.

12. The excavation support structure of claim 9, wherein a ratio of the volume of the soil-cement columns to the total volume of the support structure is less than about 35%.

13. The excavation support structure of claim 9, further comprising groups of soil-cement columns positioned between the rows of soil-cement columns, wherein the groups of soil-cement columns are surrounded by soil.

14. The excavation support structure of claim 13, wherein a ratio of the volume of the soil-cement columns to the total volume of the support structure is less than about 35%.

15. An excavation support structure having a vertical face, the support structure comprising:

a primary row of soil-cement columns along the vertical face, and two or more secondary rows of soil-cement columns perpendicular to and adjoining the primary row, each secondary row including at least two soil-cement columns, wherein the secondary rows of soil-cement columns are surrounded by soil except where the secondary rows adjoin the primary row, and the soil-cement columns are positioned within the support structure so as to form a composite structure with the soil surrounding the soil-cement columns.

16. The excavation support structure of claim 15, wherein the soil-cement columns are distributed within the support structure so that failure due to formation of a shear surface occurs at a lesser applied force than failure due to extrusion of soil between the columns.

17. The excavation support structure of claim 15, wherein the vertical face is exposed.

18. The excavation support structure of claim 15, further comprising a wall constructed along the vertical face.

19. The excavation support structure of claim 15, wherein a ratio of the volume of the secondary rows of soil-cement columns to the total volume of the secondary rows of soil-cement columns and the soil surrounding the secondary rows is less than about 35%.

20. The excavation support structure of claim 15, further comprising groups of soil-cement columns positioned between the secondary rows of soil-cement columns, wherein the groups of soil-cement columns are surrounded by soil.

21. The excavation support structure of claim 20, wherein a ratio of the volume of the secondary rows and groups of soil-cement columns to the total volume of the secondary rows and groups of soil-cement columns and the soil surrounding the secondary rows and groups is less than about 35%.

22. An excavation support structure having a vertical face, the support structure comprising:

an array of two or more soil-cement columns positioned internal to the vertical face, the columns positioned within the array so that each of the columns is not connected by soil-cement to any other column, and soil surrounding the soil-cement columns except where the soil-cement columns meet the vertical face, wherein the soil-cement columns are positioned within the support structure so as to form a composite structure with the soil surrounding the soil-cement columns.

23. The excavation support structure of claim 22, wherein a replacement ratio of the support structure is less than about 35%.

24. An excavation support structure having a vertical face, the support structure comprising:

an array of two or more soil-cement columns positioned internal to the vertical face, the columns positioned within the array so that each of the columns is not connected by soil-cement to any other column, and soil surrounding the soil-cement columns except where the soil-cement columns meet the vertical face, wherein the soil-cement columns are distributed within the support structure so that failure due to formation of a shear surface occurs at a lesser applied force than failure due to extrusion of soil between the columns.

* * * * *